US010119694B2

(12) United States Patent
Ellis

(10) Patent No.: US 10,119,694 B2
(45) Date of Patent: Nov. 6, 2018

(54) DOOR INTEGRATED LIGHTED MIRROR SYSTEM

(71) Applicant: Mary L. Ellis, Boulder, CO (US)

(72) Inventor: Mary L. Ellis, Boulder, CO (US)

( * ) Notice: Subject to any disclaimer, the term of this patent is extended or adjusted under 35 U.S.C. 154(b) by 0 days.

(21) Appl. No.: 14/743,042

(22) Filed: Jun. 18, 2015

(65) Prior Publication Data

US 2016/0369998 A1 Dec. 22, 2016

(51) Int. Cl.

| | |
|---|---|
| ***F21V 33/00*** | (2006.01) |
| ***F21V 23/04*** | (2006.01) |
| ***E06B 7/00*** | (2006.01) |
| *F21W 131/302* | (2006.01) |

(52) U.S. Cl.

CPC ..... *F21V 23/0492* (2013.01); *E06B 7/00* (2013.01); *F21V 33/006* (2013.01); *F21V 33/0016* (2013.01); *F21W 2131/302* (2013.01)

(58) Field of Classification Search

CPC ... F21V 33/004; F21V 33/0016; A45D 42/10; F21W 2131/302; A47G 2200/08; A47B 67/005

See application file for complete search history.

(56) References Cited

U.S. PATENT DOCUMENTS 3,794,828 A * 2/1974 Arpino ..... A45C 5/005 307/38
5,212,907 A * 5/1993 Van Sandt ..... E06B 7/28 174/86
5,909,950 A * 6/1999 Seok ..... F25D 23/028 312/116
6,059,420 A * 5/2000 Rogers ..... A47F 3/0434 362/223
7,347,573 B1 * 3/2008 Isler ..... A45D 42/10 359/854
7,850,326 B2 * 12/2010 Herper ..... A47B 97/00 362/127
7,953,648 B2 * 5/2011 Vock ..... G06Q 10/043 705/27.2

(Continued)

*Primary Examiner* — Robert May
(74) *Attorney, Agent, or Firm* — William J. Benman; Benman, Brown & Williams

(57) ABSTRACT

A door integrated lighted mirror system of the present invention. In the best mode, the invention includes a door mounted on a structure at least one hinge; a mirror mounted on the door; first and second illumination elements mounted on the door on opposite sides of the mirror; and means for controlling the light output by the illumination elements. In the illustrative embodiment, the illumination elements are light emitting diode arrays with outputs filtered by diffusers. A control system is mounted in the door for controlling the light output by the illumination elements. In one embodiment, the light output by the illumination elements is controlled by a first switch mounted in a hinge of the door and a second switch mounted in a door knob on the door. The control system allows the user to control the color and intensity profile of the diode arrays mounted on the door. A camera may be included in the system along with a wireless transceiver in the control system to send images of the user wearing virtual clothing from a database displayed on an integrated touchscreen and electronic display to a friend or family member via the user's smartphone.

13 Claims, 3 Drawing Sheets

(56) References Cited

U.S. PATENT DOCUMENTS

| | | | | |
|---|---|---|---|---|
| 8,339,526 | B2 * | 12/2012 | Minikey, Jr. | B60R 1/12 349/11 |
| 8,643,481 | B2 * | 2/2014 | Campbell | B60R 1/12 340/438 |
| 2010/0170289 | A1 * | 7/2010 | Graziano | H04N 7/181 62/449 |
| 2010/0296298 | A1 * | 11/2010 | Martin, Jr. | A45D 42/10 362/311.06 |
| 2011/0194200 | A1 * | 8/2011 | Greenlee | A47G 1/04 359/860 |
| 2012/0162970 | A1 * | 6/2012 | Bichrest | A45D 42/10 362/135 |

* cited by examiner

DOOR INTEGRATED LIGHTED MIRROR SYSTEM

REFERENCE TO RELATED APPLICATION

This is a Continuation-in-Part of copending U.S. patent application Ser. No. 13/134,229, filed May 30, 2011 by M. Ellis and entitled ILLUMINATED MIRROR DESIGN AND METHOD and Ser. No. 14/254,188 filed Apr. 16, 2014 by M. Ellis entitled SYSTEM AND METHOD FOR PROVIDING GRADIENT INTENSITY ILLUMINATION FOR LIGHTED MIRRORS FOR DRESSING ROOMS AND OTHER APPLICATIONS the teachings of both of which are hereby incorporated herein by reference.

BACKGROUND OF THE INVENTION

Field of the Invention

The present invention relates to lighting systems. More specifically, the present invention relates to illumination systems used for dressing and other applications.

Description of the Related Art

U.S. patent application entitled ILLUMINATED MIRROR DESIGN AND METHOD, Ser. No. 13/134,229, filed May 30, 2011 by M. Ellis, the teachings of which have been incorporated herein by reference, addressed the need in the art for an improved illumination system for dressing rooms by providing an elongate rectangular mirror; a first diffuser mounted on a first side of the mirror in parallel relation along a longitudinal axis thereof; a second diffuser mounted on a second side of the mirror in parallel relation along said longitudinal axis; and an array of light emitting diodes mounted along an edge of the first and second diffusers.

The Ellis mirror is a modular integrated mirror and lighting unit or appliance that offers the potential to enhance user perceptions of themselves in (and out of) the clothes they are considering.

Unfortunately, in many environments, space is a premium. Accordingly, there is a need for a system for providing the benefit of the Ellis illumination system in a spatially limited environment.

SUMMARY OF THE INVENTION

The need in the art is addressed by the door integrated lighted mirror system of the present invention. In the best mode, the invention includes a door mounted on a structure at least one hinge; a mirror mounted on the door; first and second illumination elements mounted on the door on opposite sides of the mirror; and means for controlling the light output by the illumination elements.

In the illustrative embodiment, the illumination elements are light emitting diode arrays with outputs filtered by diffusers. A control system is mounted in the door for controlling the light output by the illumination elements. In one embodiment, the light output by the illumination elements is controlled by a first switch mounted in a hinge of the door and a second switch mounted in a door knob on the door. The control system allows the user to control the color and intensity profile of the diode arrays mounted on the door. A camera may be included in the system along with a wireless transceiver in the control system to send images of the user wearing virtual clothing from a database displayed on an integrated touchscreen and electronic display to a friend or family member via the user's smartphone.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention is a door integrated lighted mirror design and method. The inventive door integrated lighted mirror provides a means for optimizing lighting and viewing conditions in a small dressing room environment.

Figure 1:
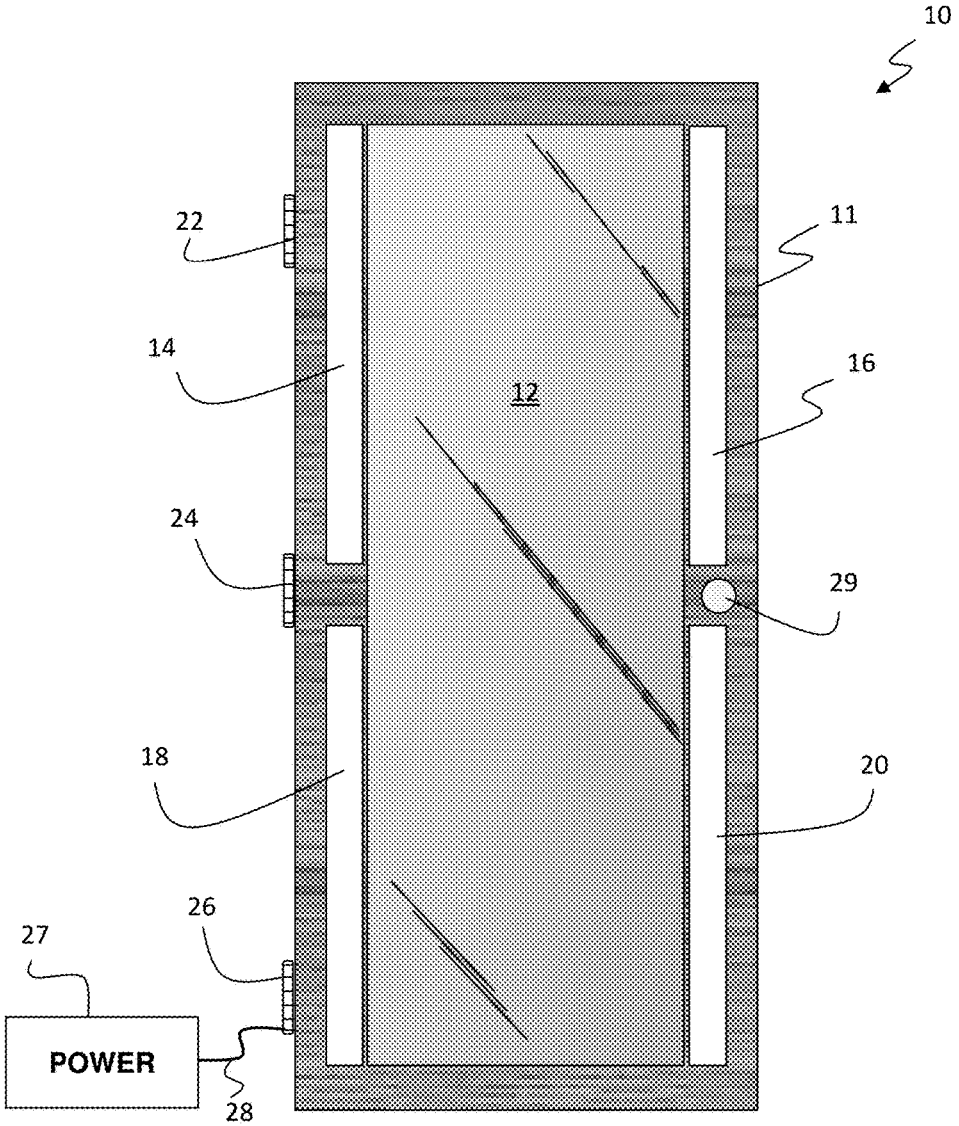
FIG. 1 is a frontal view of an illustrative embodiment of a door integrated lighted mirror implemented in accordance with the teachings of the present invention.

FIG. 1 is a frontal view of an illustrative embodiment of a door integrated lighted mirror system implemented in accordance with the teachings of the present invention. The system 10 includes a door 11 onto which a mirror 12 is mounted. The door may be of conventional wood or metal construction. The mirror 12 is fabricated of glass, metal, Plexiglas or other suitably reflective surface. In the best mode, the mirror 12 is fabricated of standard high-quality (e.g. ¼ inch) distortion-free glass. The mirror 12 is planar and has a longitudinal axis not shown along the length thereof. In the illustrative embodiment, the mirror is 24 inches by 72 inches. However, the present teachings are not limited to the size or shape of the mirror. The mirror is mounted on the surface of the door 11 or inlaid therein.

The mirror is sandwiched between four illumination elements 14, 16, 18 and 20. The illumination elements 14, 16, 18 and 20 include light diffusers that distribute light from light emitting diodes (LEDs), organic light emitting diodes OLEDS or other suitable light emitting devices. In the best mode, the illumination elements are light emitting diode arrays with diffusers implemented in accordance with the teachings of the above-referenced Ellis applications ('188 and '229).

As discussed more fully below, the illumination elements 14, 16, 18 and 20 may be controlled by touchscreen controls integrated into the mirror 12, by a switch integrated into one or more of the door hinges 24, 24 and/or 26 or via the door knob 29. Power is provided to the illumination elements 14, 16, 18 and 20 via an external source of power 27, power cord 28 and one of the hinges 26.

Figure 2:
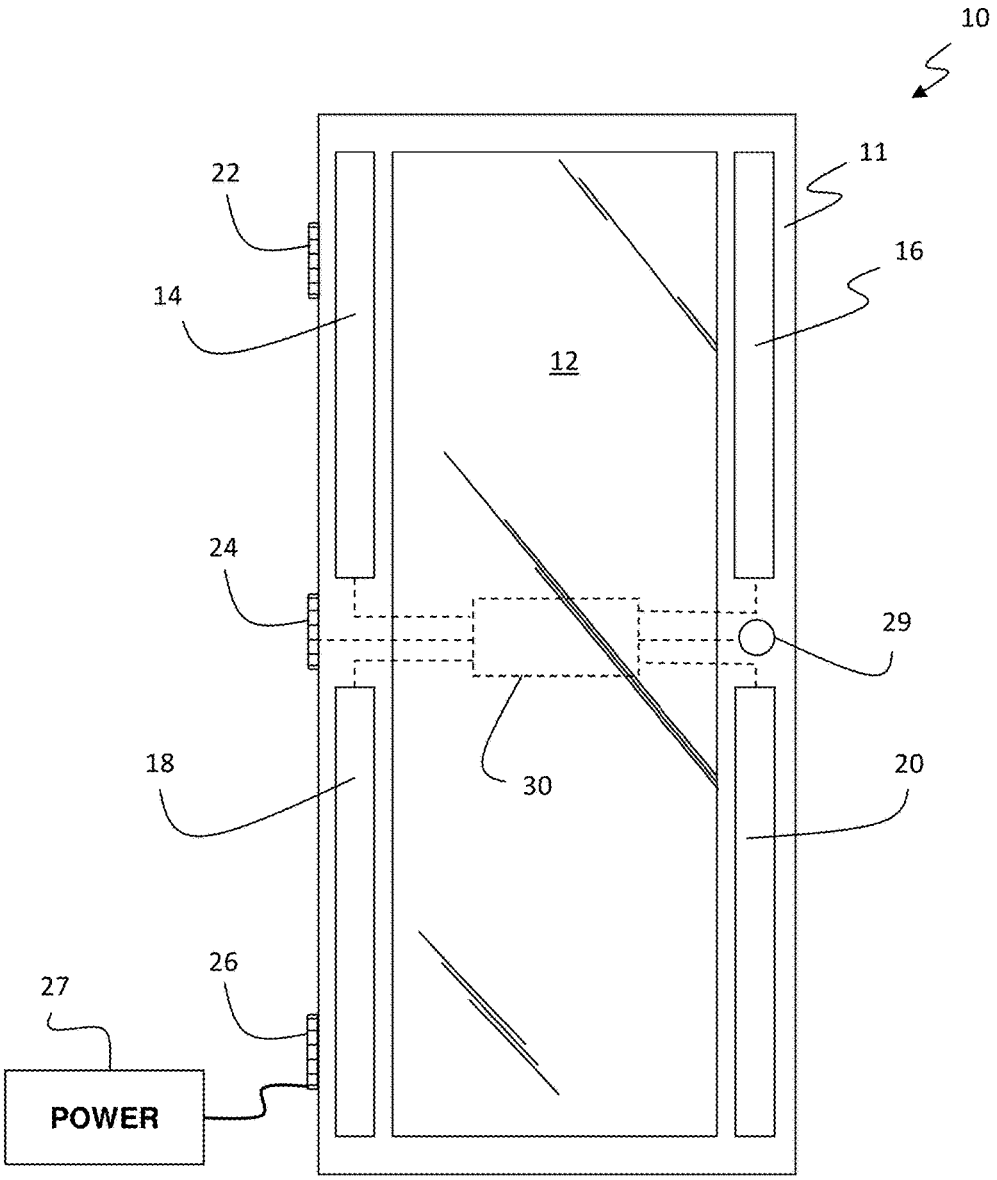
FIG. 2 is a simplified schematic view of the door integrated lighted mirror system of FIG. 1.

FIG. 2 is a schematic representation of the illustrative implementation of the illuminated door depicted in FIG. 1. As shown in FIG. 2, the system 10 includes a control system 30 adapted for use with the illumination elements. The system controller 30 may be implemented with a tablet computer (with a software application) mounted in a cradle interface not shown. In this case, the control system 30 is implemented with a wireless transceiver, computer processor and tangible medium on which software is stored.

Whether implemented with a discrete electronic circuit or a computer, the control system 30 is coupled to each of the illumination elements 14, 16, 18 and 20 through wire connections shown in phantom. Optionally, the control system 30 receives user inputs from a switch integrated into the door knob 29 or from the user's smartphone. The control system 30 receives power from the power supply 27, line 28 and hinges 24 and 26.

The system 10 could be implemented with a switch in a hinge that causes the illumination elements to turn on when the door is closed and a push on the control knob toggles that automatic 'on' when closed operation 'off' or 'on'. A variable resistance or other mechanism may be included in the door knob 29 to effect a dimming of the illumination elements 14, 16, 18 and 20 through the control system 30.

Figure 3:
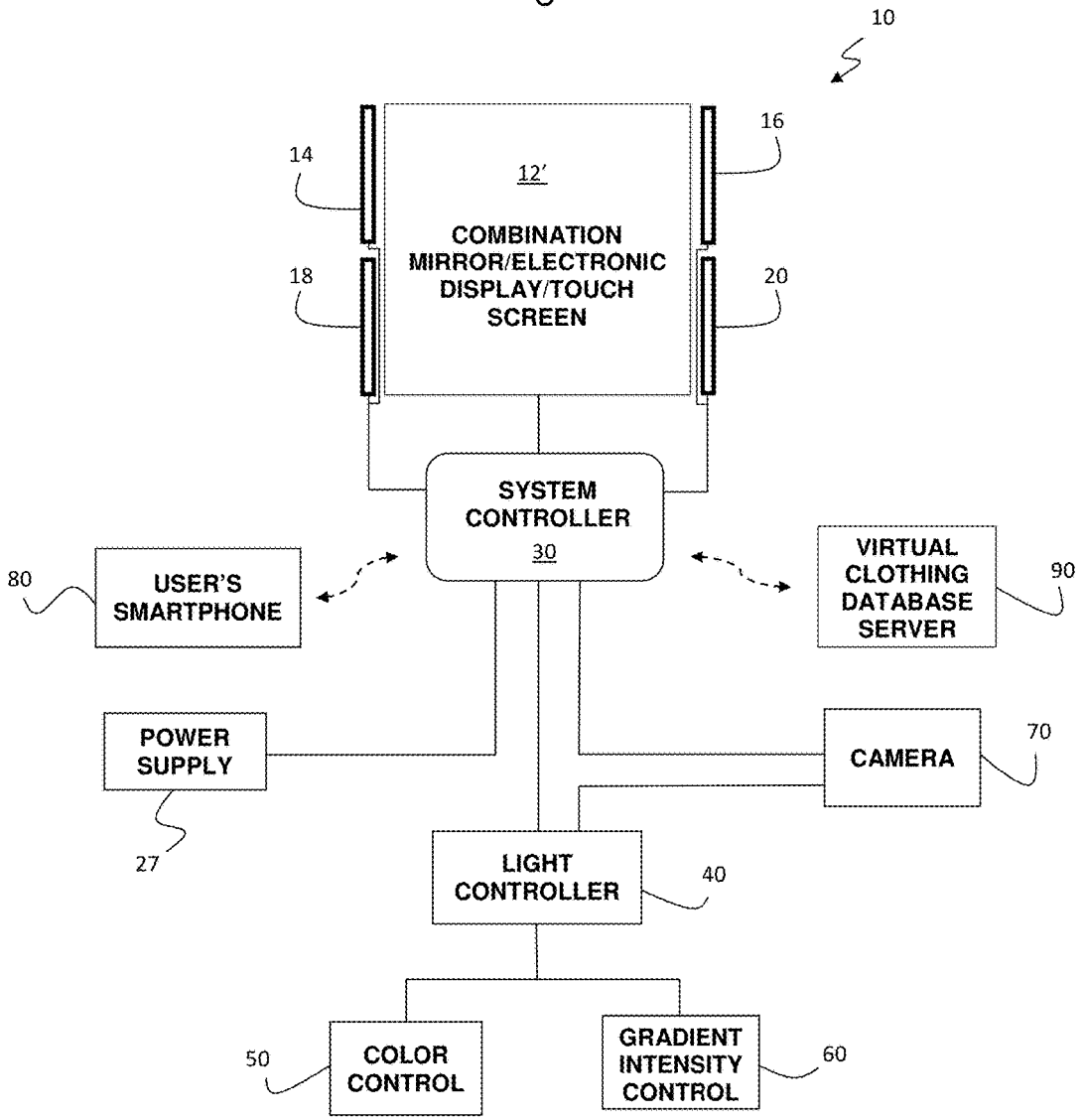
FIG. 3 is a diagram that shows operational inputs into the control system depicted in FIG. 2 in accordance with various alternative and optional embodiments of the present teachings.

FIG. 3 is a diagram that shows operational inputs into the control system 30 depicted in FIG. 2 in accordance with various alternative and optional embodiments of the present teachings. As shown in FIG. 3, a color and intensity light controller 40, color control 50 and gradient intensity control 60 may be provided in accordance with the teachings of the above referenced Ellis ('188) application. These components allow for control of the color and intensity profile of the light output by the illumination elements 14, 16, 18 and 20 via an optional combination mirror and electronic touch screen display 12', control knob 29, and control system 30. In addition, a camera 70 (not shown) may be added to the system 10 to allow the user to send still and/or video images to friends and family via a smartphone 80 that is wirelessly coupled to the control system 30. (The camera may be implemented as a fiber optic camera concealed in the frame of the door 11 and coupled to the control system 30.) Through the user's smartphone and application software, the control system 30 displays virtual clothing pulled from a database 90 by the user and displayed on the combination mirror and electronic display 12'. In this case, the mirror 12' is not a mirror of conventional construction but instead implemented with a reflective surface or film mounted on a touchscreen display.

The present invention has been described herein with reference to a particular embodiment for a particular application. Those having ordinary skill in the art and access to the present teachings will recognize additional modifications, applications and embodiments within the scope thereof. For example, the invention is not limited to the number of illumination elements used or the type thereof. The light elements can be other shapes including square, rectangular, circular, irregular, etc. without departing from the scope of the present teachings. The invention is not limited to use in dressing room applications.

It is therefore intended by the appended claims to cover any and all such applications, modifications and embodiments within the scope of the present invention.

Accordingly,

What is claimed is:

1. An illumination system for a dressing room comprising:

a door mounted on a structure;

an elongate dressing mirror constructed of planar high-quality distortion free reflective material mounted on the door;

first and second illumination elements mounted on the door on opposite sides of the mirror to project illumination directly toward a user standing in front of the mirror, whereby the mirror is sandwiched between the illumination elements; and an arrangement for controlling the light output by the illumination elements.

2. The invention of claim 1 wherein said illumination elements are light emitting diode arrays.

3. The invention of claim 2 wherein each of the diode arrays is covered by a diffuser.

4. The invention of claim 1 wherein the mirror includes an integrated touchscreen.

5. The invention of claim 1 wherein the arrangement for controlling the light output by the illumination elements includes a control system mounted in the door electrically coupled to a variable resistor.

6. The invention of claim 1 wherein the arrangement for controlling the light output by the illumination elements includes a light controller system.

7. The invention of claim 6 wherein the light controller system includes means for controlling the color of the light output by the illumination elements.

8. The invention of claim 6 wherein the light controller system includes an arrangement for controlling the gradient intensity of light output by the illumination elements.

9. The invention of claim 1 wherein the illumination system includes a camera.

10. The invention of claim 1 wherein the illumination system includes a smartphone.

11. The invention of claim 1 wherein the illumination system includes a virtual clothing database server.

12. An illumination system comprising:

a door mounted on a structure via at least one hinge, said door having a frame and a knob;

a mirror mounted on the door, said mirror including an integrated electronic display, said mirror and integrated display being implemented with a reflective surface or film mounted on a touchscreen display;

first and second illumination elements mounted on the door on opposite sides of the mirror, said illumination elements being light emitting diode arrays, each of the diode arrays being covered by a diffuser;

a control system mounted on or in the door;

a smartphone adapted to be wirelessly coupled to the control system with software for pulling images of clothing from a remote database and sending the images to the controller whereby the controller sends signals to the integrated display such that the images appear on the user in the mirror and the integrated display as virtual clothing and a fiber optic camera concealed in the frame of the door adapted to send images to the smartphone via said control system.

13. An illumination system for a dressing room comprising:

a door having a knob mounted on a structure via at least one hinge;

an elongate dressing mirror constructed of planar high-quality distortion free reflective material mounted on the door;

first and second illumination elements mounted on the door on opposite sides of the to project illumination directly toward a user standing in front of the mirror, whereby the mirror is sandwiched between the illumination elements; and an arrangement for controlling the light output by the illumination elements, said means for controlling the light output by the illumination elements including:

a switch mounted in the hinge or door knob to effect actuation of the light illumination elements; and a variable resistor mounted in the door knob to enable the user to control the intensity of the illumination elements.

* * * * *